United States Patent [19]

Henry, Jr.

[11] Patent Number: 4,765,612

[45] Date of Patent: Aug. 23, 1988

[54] U-LEG BAR EXERCISING DEVICE

[76] Inventor: Roy Henry, Jr., 66 Corbin Ave., East Patchogue, N.Y. 11772

[21] Appl. No.: 36,361

[22] Filed: Apr. 8, 1987

[51] Int. Cl.[4] ..... A63B 21/00

[52] U.S. Cl. ..... 272/119; 272/117; 224/270

[58] Field of Search ..... 272/93, 116, 117, 119, 272/123, 143, DIG. 4; 224/101, 270

[56] References Cited

U.S. PATENT DOCUMENTS

| | | | |
|---|---|---|---|
| 4,296,924 | 10/1981 | Anzaldua et al. | 272/117 |
| 4,319,704 | 3/1982 | Rosen | 224/270 |
| 4,345,756 | 8/1982 | Hoagland | 272/117 |
| 4,391,397 | 7/1983 | Taylor, Jr. | 272/119 X |
| 4,429,870 | 2/1984 | Gibbs | 272/117 |

FOREIGN PATENT DOCUMENTS

| | | | |
|---|---|---|---|
| 122994 | 8/1901 | Fed. Rep. of Germany | 272/117 |
| 3042235 | 5/1982 | Fed. Rep. of Germany | 272/119 |

*Primary Examiner*—Richard J. Apley
*Assistant Examiner*—Robert D. Bahr
*Attorney, Agent, or Firm*—Richard L. Miller

[57] ABSTRACT

This exercise device is designed to develop the leg muscles of a person through the employment of weights. Primarily, it includes a U-shaped bar for fitting around the waist of the user, and a weight support sleeve is pivotally received on the legs of the U-shaped bar. The device further includes pad portions for the hips of the user, pads for the arms of the user, handle grips, and also a support stand for placement of the device when not in use.

5 Claims, 1 Drawing Sheet

U-LEG BAR EXERCISING DEVICE

BACKGROUND OF THE INVENTION

The instant invention relates generally to body building devices, and more particularly, to a U-leg bar exercising device.

Numerous body building devices have been provided in the prior art that are adapted to develop leg muscles. While these units may be suitable for the particular purpose to which they address, they would not be as suitable for the purpose of the present invention as hereafter described.

SUMMARY OF THE INVENTION

A primary object of the present invention is to provide a U-leg bar exercising device that will overcome the shortcomings of the prior art devices.

Another object is to provide a U-leg bar exercising device, which will rest upon the hips of a user while doing squatting type exercises, so as to develop the leg muscles.

An additional object is to provide a U-leg bar exercising device, which will include removable weights on each side and will have handles for holding the device.

A further object is to provide a U-leg bar exercising device, that is simple and easy to use.

A still further object is to provide a U-bar leg exercising device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
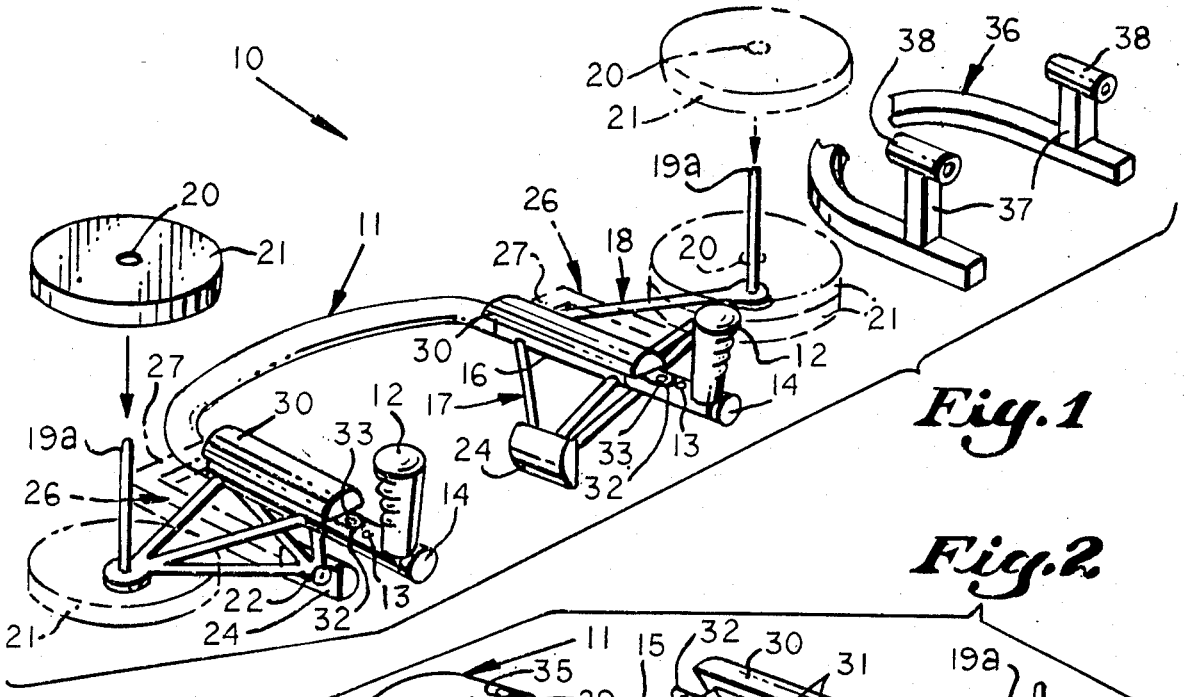
FIG. 1 is a perspective view of the invention per se.
Figure 2:
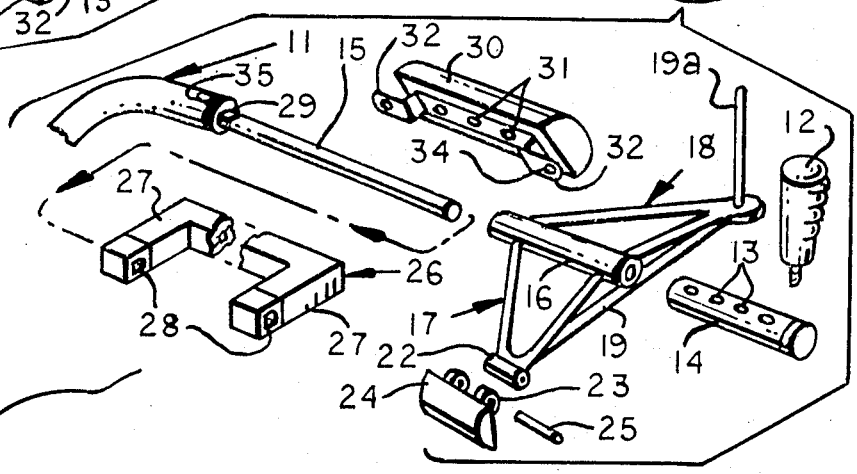
FIG. 2 is a fragmentary, exploded perspective view of some of the components thereof.
Figure 3:
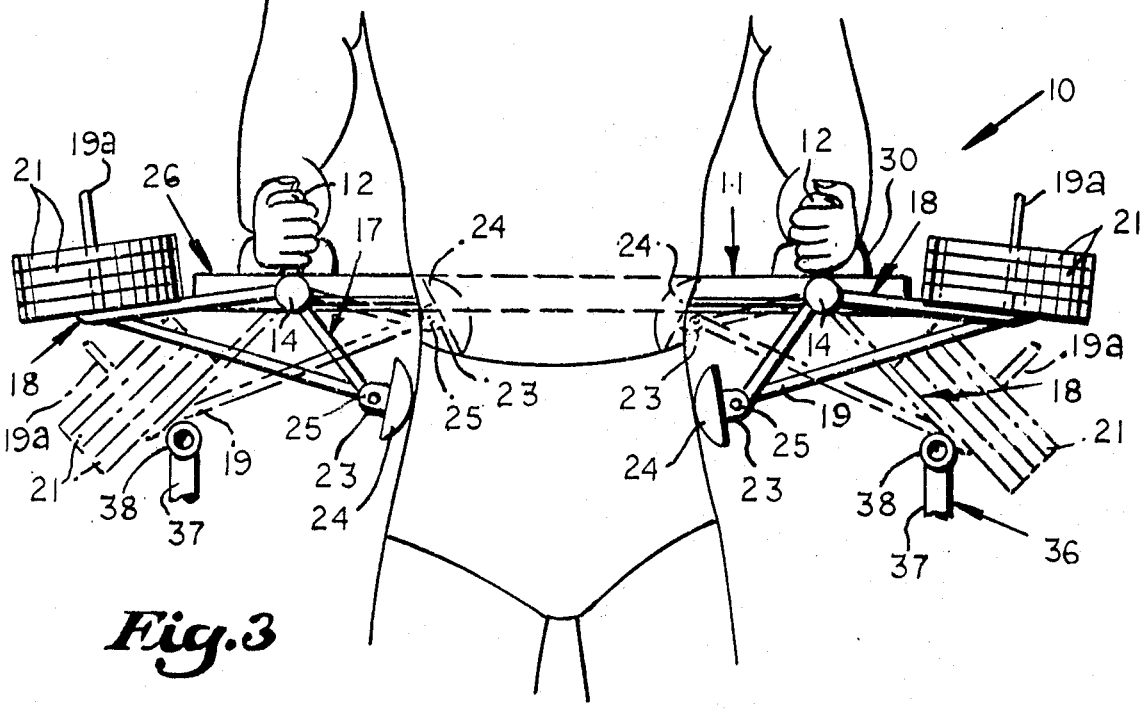
FIG. 3 is a front elevational view of the invention shown fitted around a person's hips, ready for use.

Turning now descriptively to the drawings, in which like reference characters denote like elements throughout the several views, FIGS. 1 and 2 more particularly illustrate a device 10 which is shown to include a U-shaped bar 11 having a pair of handles 12 threaded into any of a series of spaced and threaded openings 13 provided in a sleeve 14 received on each leg 15 of bar 11, and a weight support second sleeve 16 is received adjacent to each sleeve 14 on legs 15, and is pivotal thereon. A V-shaped arm 17 is fixedly secured at its leg portions to the outer periphery of second sleeve 16, and a similar shaped arm 18 is similarly secured to the outer periphery on the opposite side of the second sleeve 16. A cross bar 19 is fixedly secured to the opposite ends of arm 17 and 18 for maximum strength, and a post **19*a* is fixedly secured at an end to the extending end of arm 18, for being received in openings 20 of a plurality of weights 21. A third sleeve 22 is fixedly secured to the extending end of a arm 17 and is received between a pair of spaced eye brackets 23 fixedly secured to one side of a hip pad 24, and a pin 25 is received through third sleeve 22 and the eye brackets 23. The ends of pin 25 are preferably flared for their retainment in pad 24 and sleeve 22, or may be substituted for by another form of fastener. A second U-shaped bar 26 is provided and the legs 27 thereof, include a square shaped opening 28, one of which, receives a similarly square portion 29 of a leg 15 of bar 11, for rendering second bar 26 stationary on leg 15. The pair of seconds bar 26 extend outward of device 10 and serve as a stop against further upward travel of the pair of arms 18**.

An arm rest pad 30 is provided and includes a mounting bracket **30*a* secured thereto, by suitable fasteners 31, and end portions 32 of a bracket 30 are secured to sleeve 14 by screw fasteners 33 received in openings 34, 14 and 35 respectively. A support bar frame 36 is also provided for supporting device 10 when not in use, and also serves to enable the user to place himself within device 10 easily. Frame 36 is of U-shape and is provided with a vertical post 37 fixedly secured near each end, and a pair of third sleeves 38 are fixedly secured to the top of the posts 37 and provide for engagement with cross bar 19**.

In use, the user positions himself/herself within the confines of the support frame 36 and grips the handles 12. He/she then manipulates device 10 until the hip pads 24 are in engagement with his/her hips, and the weights 21 provide constant engagement with his/her hips. He/she then proceeds to perform up and down squatting exercise for developing his/her leg muscles. When finished, he/she again positions himself/herself within frame 36 and releases device 10, which will again be supported by frame 36, the sleeves being the support of the arms 18.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An exercise device comprising:

a first U-shaped bar to be received about the waist of a user;

a first pair of sleeves received on the ends of said first U-shaped bar, said first pair of sleeves including a pair of handles;

a second pair of sleeves rotatively received on the ends of said first U-shaped bar and retained on said U-shaped bar by said first pair of sleeves, each of said second pair of sleeves having a first and second arms secured thereto, each of said first arms retaining a hip pad and each of said second arms retaining a plurality of weights;

a pair of second U-shaped bars non-rotatively received on the ends of said first U-shaped bar, said second U-shaped bars serving as stop means against further upward travel of said weights;

a pair of arm rest pads secured to said first U-shaped bar and said first sleeves, and a third U-shaped bar serving as a support frame means for supporting said device prior to use.

2. An exercise device as set forth in claim 1, wherein the first U-shaped bar is provided with a pair of threaded openings, the first pair of sleeves is provided with a row of equally spaced, threaded openings, and the handles and arm rest pads are provided with screw fasteners for mounting the handles to the first pair of sleeves, and the arm rest pads to first U-shaped bar and the first pair of sleeves.

3. An exercise device as set forth in claim 2, wherein each of said first and second arms are fixedly secured at one end to the outer periphery of their respective second sleeve, each second end of said first arms includes a third sleeve fixedly secured thereto and a hip pad pivotally mounted on said third sleeve, each second end of said second arms including a weight receiving post fixedly mounted thereto, and a crossbar fixedly secured to said first and second arms.

4. An exercise device as set forth in claim 3, wherein said pair of second U-shaped bars include a square opening extending transversely through each leg; and said first U-shaped bar includes a similar square portion on each leg, where each leg of said first U-shaped bar is received in the opening of said second U-shaped bar, and said second U-shaped bar extend outwardly to serve as stop means by engaging said second arm and preventing further upper travel of said weights.

5. An exercise device as set forth in claim 4, wherein said third U-shaped bar is horizontally disposed and includes a vertically disposed post fixedly secured to each leg of said third U-shaped bar, and a horizontally disposed fourth sleeve fixedly secured to each post, where said fourth sleeve removably receive said crossbar for supporting said device.

* * * * *